US007975448B2

(12) United States Patent
Jahn et al.

(10) Patent No.: US 7,975,448 B2
(45) Date of Patent: Jul. 12, 2011

(54) DRYWALL CHANNEL WITH PRE-PUNCHED LOCATING TABS

(75) Inventors: Peter G. Jahn, Palos Park, IL (US); Scott G. Jankovec, Elmhurst, IL (US)

(73) Assignee: Chicago Metallic Corporation, Chicago, IL (US)

( * ) Notice: Subject to any disclaimer, the term of this patent is extended or adjusted under 35 U.S.C. 154(b) by 0 days.

(21) Appl. No.: 12/057,600

(22) Filed: Mar. 28, 2008

(65) Prior Publication Data

US 2008/0236068 A1 Oct. 2, 2008

Related U.S. Application Data

(60) Provisional application No. 60/908,833, filed on Mar. 29, 2007.

(51) Int. Cl.
*E04B 9/00* (2006.01)

(52) U.S. Cl. ..... 52/506.07; 52/220.6; 52/506.1

(58) Field of Classification Search .. 52/506.06–506.09, 52/278.1, 22, 326, 665, 506.01, 506.1, 664, 52/220.6

See application file for complete search history.

(56) References Cited

U.S. PATENT DOCUMENTS

| | | | | | |
|---|---|---|---|---|---|
| 2,275,109 | A | | 3/1942 | McGee | |
| 2,586,327 | A | * | 2/1952 | Haertel | 52/506.09 |
| 2,866,233 | A | * | 12/1958 | Lydard | 403/387 |
| 2,990,921 | A | * | 7/1961 | Wilde | 403/178 |
| 3,270,472 | A | | 9/1966 | Gilbert | |
| 3,536,345 | A | * | 10/1970 | Leifer | 405/257 |
| 3,602,473 | A | * | 8/1971 | Van Riet et al. | 248/317 |
| 3,798,865 | A | * | 3/1974 | Curtis | 52/665 |
| 3,989,399 | A | * | 11/1976 | Slowbe | 403/245 |
| 4,333,290 | A | | 6/1982 | Koberstein | |
| RE31,528 | E | * | 3/1984 | Mieyal | 52/836 |
| 4,541,219 | A | | 9/1985 | Parker | |
| 4,586,841 | A | * | 5/1986 | Hunter | 403/230 |
| 4,587,781 | A | | 5/1986 | Uttley et al. | |
| 4,610,562 | A | * | 9/1986 | Dunn | 403/233 |
| 4,757,663 | A | | 7/1988 | Kuhr | |
| 4,802,315 | A | | 2/1989 | Reed | |
| 4,805,364 | A | | 2/1989 | Smolik | |
| 4,854,096 | A | | 8/1989 | Smolik | |
| 4,918,899 | A | | 4/1990 | Karytinos | |
| 4,986,052 | A | | 1/1991 | Nelson | |

(Continued)

OTHER PUBLICATIONS

Drywall Framing Systems Plaster Steel Products Vinyl & Paper Beads & Trims, Marino/Ware Service Catalog, South Plainfield, New Jersey.

*Primary Examiner* — Eileen Lillis
*Assistant Examiner* — James Ference
(74) *Attorney, Agent, or Firm* — Cook Alex Ltd

(57) ABSTRACT

A wall channel for a drywall ceiling has a generally U-shaped cross-section with a vertical leg interconnecting two generally-horizontal legs. The lower horizontal leg is adapted to support an inverted tee-runner that has a vertical web and opposed flanges, the opposed flanges being adapted to rest on the horizontal leg of the wall angle. The lower horizontal leg is formed with a plurality of pairs of locating tabs that are spaced apart a distance sufficient to accommodate the width of the opposed flanges of the tee-runner. The upper horizontal leg is formed with a plurality of pairs of locating tabs that are spaced apart a distance sufficient to accommodate the width of the reinforcing bulb of the tee-runner.

5 Claims, 2 Drawing Sheets

U.S. PATENT DOCUMENTS 5,046,294 A * 9/1991 Platt ..... 52/506.06
5,157,883 A 10/1992 Meyer
5,195,289 A * 3/1993 LaLonde et al. ..... 52/506.06
5,197,247 A 3/1993 Elderson
5,222,335 A 6/1993 Petrecca
5,287,673 A 2/1994 Kreikemeier
5,325,651 A * 7/1994 Meyer et al. ..... 52/715
5,394,665 A 3/1995 Johnson
5,481,843 A 1/1996 Kreikemeier
5,553,433 A 9/1996 Lang
5,761,873 A 6/1998 Slater
5,797,233 A 8/1998 Hascall
5,799,453 A 9/1998 Westerlund
5,839,246 A 11/1998 Ziegler et al.
5,848,512 A 12/1998 Conn
5,937,605 A 8/1999 Wendt
5,970,672 A 10/1999 Robinson
6,018,923 A 2/2000 Wendt
6,047,512 A 4/2000 Wendt et al.
6,138,425 A 10/2000 Wendt
6,176,053 B1 1/2001 St. Germain
6,199,343 B1 3/2001 Sauer et al.
6,298,623 B1 * 10/2001 Wendt ..... 52/506.06
6,301,854 B1 10/2001 Daudet et al.
6,418,694 B1 7/2002 Daudet et al.
6,446,406 B1 9/2002 Sauer
6,477,818 B1 11/2002 Jensen
D467,007 S 12/2002 Daudet et al.
6,523,313 B2 2/2003 Lin et al.
6,568,138 B1 5/2003 Frost et al.
6,588,165 B1 7/2003 Wright
6,643,990 B2 11/2003 Jensen
6,691,478 B2 2/2004 Daudet et al.
6,694,695 B2 2/2004 Collins et al.
6,701,686 B1 3/2004 Platt
6,708,460 B1 3/2004 Elderson
6,722,098 B2 4/2004 Platt
6,761,005 B1 7/2004 Daudet et al.
6,763,642 B2 7/2004 Platt
6,854,230 B2 2/2005 Starke
7,017,310 B2 3/2006 Brunt
7,028,432 B2 4/2006 Manos et al.
7,137,231 B2 11/2006 Harel
7,159,369 B2 1/2007 Elderson
2002/0170250 A1 11/2002 Chambers
2003/0093969 A1 5/2003 Saldana
2003/0110721 A1 6/2003 Harel
2003/0226322 A1 12/2003 Platt
2004/0074196 A1 4/2004 Saladana
2004/0074197 A1 4/2004 Saldana
2004/0074198 A1 4/2004 Saldana
2004/0163340 A1 8/2004 Harel
2004/0177581 A1 9/2004 Starke
2004/0200172 A1 10/2004 Beck et al.
2004/0250482 A1 12/2004 Jacobson et al.
2005/0115196 A1 6/2005 Raymundo et al.
2005/0120662 A1 6/2005 Paul
2005/0138890 A1 6/2005 Starke
2006/0010811 A1 * 1/2006 Platt ..... 52/506.06
2006/0016139 A1 1/2006 Beck et al.
2006/0059829 A1 3/2006 Flynn
2006/0080939 A1 4/2006 Bledsoe et al.

* cited by examiner

DRYWALL CHANNEL WITH PRE-PUNCHED LOCATING TABS

CROSS REFERENCE TO RELATED APPLICATION

This application claims the benefit of the filing date of U.S. Provisional Patent Application Ser. No. 60/908,833, filed Mar. 29, 2007.

BACKGROUND

The present application is directed to a drywall channel that may be advantageously used as part of a suspension grid or a free-span runner system for a drywall ceiling.

A suspension grid system for a drywall ceiling typically includes wall angles disposed about the perimeter of the ceiling that are secured to the walls through their vertical legs by e.g. screws, nails, staples, and/or adhesives. The wall angles are typically ten feet in length and include horizontal legs or ledges to support the ends of the tee-shaped runners or beams. Drywall sheets are secured directly to the bottom sides of the horizontal flanges of the beams by screws.

SUMMARY OF THE DISCLOSURE

In one aspect of the disclosure, a wall channel or angle for a drywall suspended ceiling is provided that has a cross-section forming a generally U-shape with a vertical leg and two generally horizontal legs. The horizontal legs are adapted to capture therebetween an inverted tee-runner that has a strengthening or reinforcing bead, a vertical web, and opposed flanges, the opposed flanges being adapted to rest on the lower horizontal leg of the wall angle.

The horizontal legs of the channel are formed with a plurality of opposed tabs for locating and capturing the tee-runners. The tabs may take different forms, but are preferably punched from the horizontal legs of the channel during a roll-forming operation. Two different configurations for the tabs are shown for purposes of illustration and not limitation.

The tabs in each pair on the lower horizontal leg are spaced apart a distance sufficient to accommodate the width of the opposed flanges of the tee-runner. The tabs in each pair on the upper horizontal leg are spaced apart a distance corresponding to the width of the reinforcing bulb of the tee-runner. The opposed pairs of tabs are spaced, on center, a pre-determined distance, preferably 8 inches, which allows an installer to space the tee-runners either 16 inches on center or 24 inches on center, as is customary.

Other features of the disclosure will become apparent upon reference to the following detailed description and accompanying drawings.

DETAILED DESCRIPTION OF THE PREFERRED EMBODIMENTS

Figure 1:
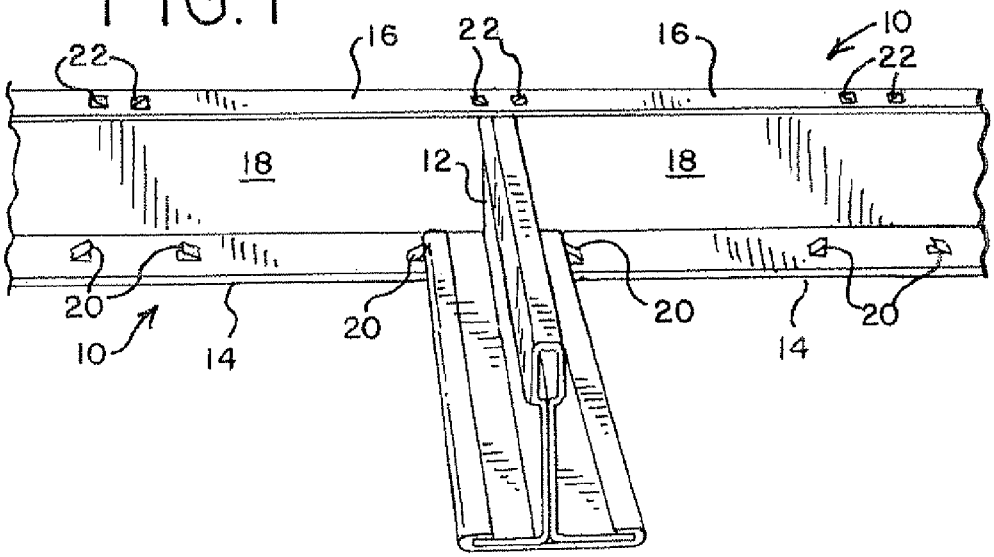
FIG. 1 is a perspective view of a drywall channel and an associated tee-runner for a suspension grid for a drywall ceiling or a suspended ceiling in accordance with a first embodiment of the present disclosure.
Figure 3:
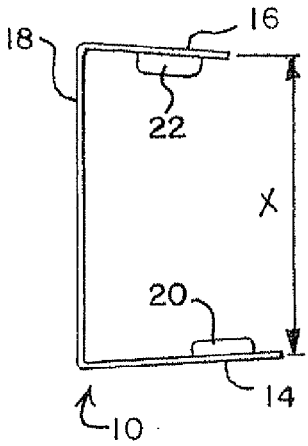
FIG. 3 is an end view of the drywall channel of FIGS. 1 and 2.
Figure 2:
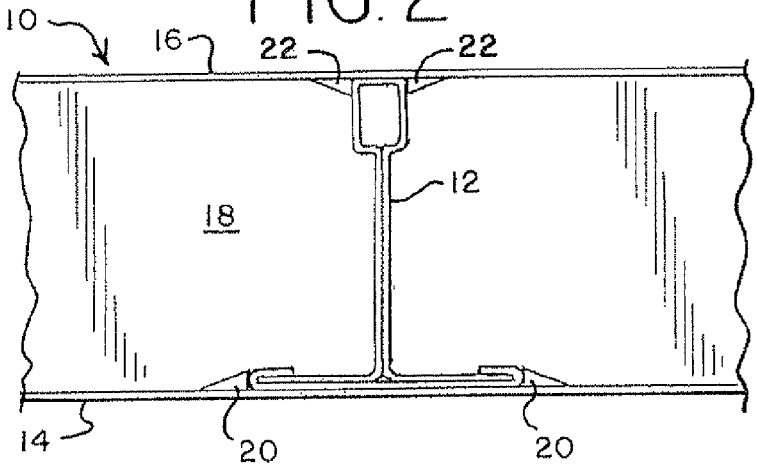
FIG. 2 is a front view of the drywall channel and tee-runner shown in FIG. 1, with the "horizontal" legs being shown straight for clarity.
Figure 4:
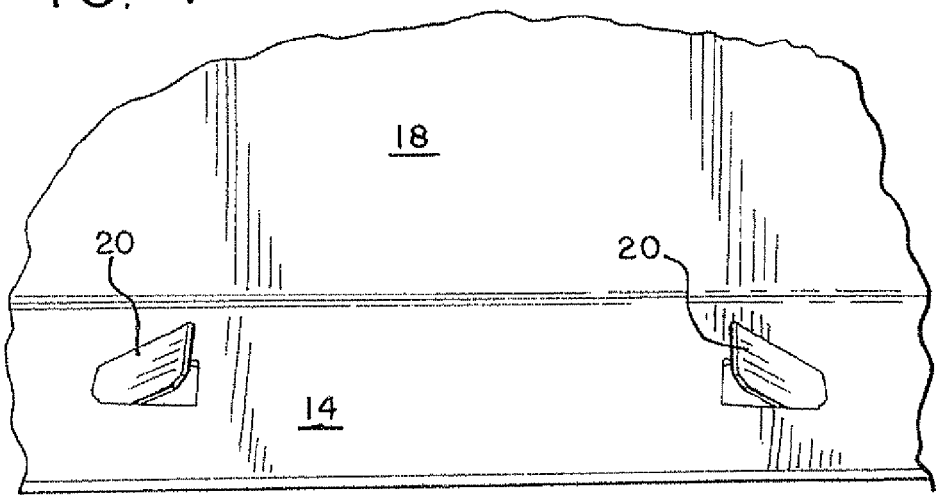
FIG. 4 is an enlarged fragmentary perspective view of the drywall channel shown in FIGS. 1-3, showing the locating tabs on the lower leg.

With reference to the drawings, a molding or channel, generally designated 10, is provided for supporting the ends of the associated tee-runners (one such tee-runner 12 being shown in FIGS. 1 and 2). The channel 10 is in the form of a generally U-shaped channel having spaced-apart horizontal legs 14, 16 connected by a vertical leg 18. (While the legs 14, 16 are referred to as "horizontal," they need only be generally or approximately horizontal, as will become apparent below.) As best seen in the end view of the drywall channel 10 in FIG. 1, the upper horizontal leg 16 is shorter than the lower horizontal leg 14, which facilitates the installation of the tee-runners with a downward motion. In the preferred embodiment, the upper leg 16 has a width of approximately ¾ inch, while the lower leg 14 has a width of approximately 1 inch.

The legs 14, 16 of the channel 10 have free ends that define or present a vertical opening "X" that is approximately equal to the height of the tee-runner that is to be received in the channel. The vertical leg 18 of the channel 10 has a height that is greater than "x." More specifically, with reference to FIG. 1, the horizontal legs 14, 16 are not perpendicular to the vertical leg 18, but form a slightly acute angle with respect thereto such that the free ends of the horizontal legs point slightly toward each other, with the opening "X" between the upper and lower legs 14, 16 being approximately equal to the height of the tee-runner 12 that is received in the channel 10 (typically approximately 1½ inches). This means that the height of the vertical leg 18 is greater than the height of the tee-runner, and permits the channel to receive the ends of tee-runners that have been distorted (i.e., vertically lengthened) when cut to length. Specifically, such cutting of the ends of the tee-runners creates a burr that increases the height of the tee-runner. The increased length of the vertical leg 18 (relative to the height of an undistorted tee-runner) accommodates this distortion and facilitates installation of the tee runners. In the preferred embodiment, the upper leg 16 forms an angle of approximately 85 degrees with respect to the vertical leg 18, while the lower leg 14 forms an angle of approximately 86 degrees with respect to the vertical leg 18.

In keeping with another aspect of the disclosure, the horizontal legs 14, 16 are provided with pairs of regularly-spaced tabs for locating and securing the tee runners 12 to the wall channel 10. To this end, and with reference to FIGS. 1-4, a first embodiment of a channel 10 is shown having a plurality of opposed, spaced pairs of cantilevered locating tabs 20, 22 according to the present invention. The tabs 20, 22 are struck from the lower leg 14 and upper leg 16 so as to have their free ends protruding into the interior of the channel 10. The tabs 20 on the lower leg 14 are spaced apart a distance sufficient to accommodate the width of the flanges on the tee-runner, while the tabs 22 on the upper leg 16 are spaced apart a distance sufficient to accommodate the reinforcing bulb of the tee-runner.

Figure 5:
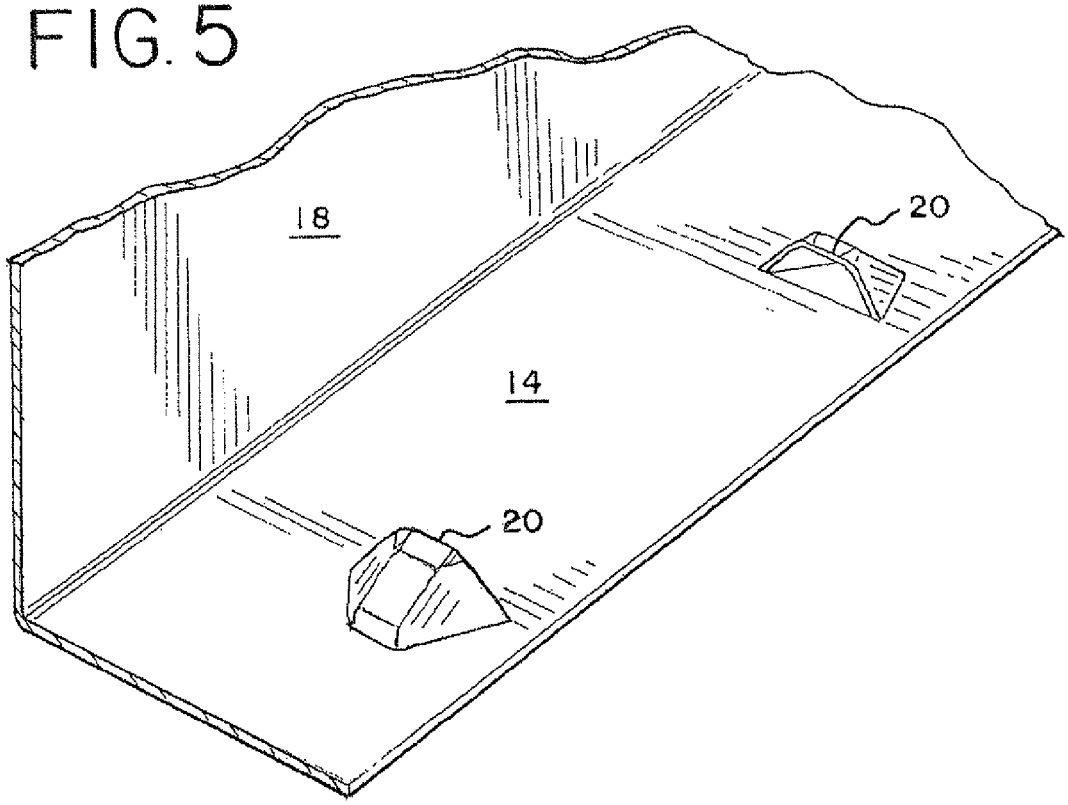
FIG. 5 is an enlarged fragmentary perspective view of a drywall channel of similar to FIG. 4, but showing an alternative configuration for the locating tabs.

Alternatively, the tabs 20 may have a D-shaped profile, as seen in FIG. 5, with the facing portions of the tabs forming an angle of preferably no more than 90 degrees with respect to the leg from which they are struck, (as seen in FIG. 2). The tabs 20 are formed from a straight or linear cut across horizontal leg that is substantially perpendicular to the vertical leg, with the cut curving or extending slightly inwardly toward the other tab in the pair. This results in the tabs 20 in FIG. 5 having a protruding lip for capturing the tee-runner.

Many different configurations for the locating tabs will be apparent to a person skilled in the art. While the tabs on the upper and lower legs of the channel have been shown as having the same configuration, it is apparent that one configuration may be used for the tabs on the lower leg and a different configuration used for the tabs on the upper leg without departing from the disclosure.

What is claimed is:

1. A suspension system for a drywall ceiling comprising at least one inverted tee-runner having a vertical web, opposed horizontal flanges at a lower end of the vertical web, and a strengthening bulb at an upper end of the vertical web;

at least one channel adapted to locate and support a free end of the tee-runner, the channel having a generally U-shaped cross section with a vertical leg and upper and lower legs having opposed surfaces, at least one of the upper and lower legs forming an acute angle with respect to the vertical leg, the upper and lower legs having a plurality of integrally-formed opposed pairs of tabs, the tabs in each pair on the lower leg being spaced apart a distance sufficient to accommodate the opposed flanges of the tee-runner, and the tabs in each pair on the upper leg being spaced apart a distance sufficient to accommodate the strengthening bulb of the tee-runner, wherein the tee-runner has a vertical height, the upper and lower legs of the channel having free ends that present a vertical opening of a first distance that is less than or equal to the height of the tee-runner, and the vertical leg of the channel having a height, defined as being the portion of the vertical leg between the opposed surfaces of the upper and lower legs, wherein the height of the vertical leg is greater than the first distance and greater than the vertical height of the tee runner; and wherein when an end of the tee-runner is installed in the channel at least one of the upper and lower legs forms an acute angle with respect to the vertical leg.

2. The suspension system of claim 1 wherein both the upper and lower legs form an acute angle with respect to the vertical leg.

3. The suspension system of claim 2 wherein the upper leg of the channel forms an angle of 85° with respect to the vertical leg and the lower leg forms an angle of 86° with respect to the vertical leg.

4. The suspension system of claim 1 wherein each tab in the upper and lower legs of the channel comprises a single linear cut in the leg and a generally D-shaped vertically-extending profile.

5. The suspension system of claim 1 wherein the upper leg of the wall channel is shorter than the lower leg.

* * * * *